US005193718A

United States Patent [19]

Hassell et al.

[11] Patent Number: 5,193,718

[45] Date of Patent: Mar. 16, 1993

[54] QUICK ELECTRONIC DISCONNECT FOR A BEVERAGE DISPENSING VALVE

[75] Inventors: David A. Hassell, Anoka, Minn.; Karl A. Senghaas, San Antonio, Tex.

[73] Assignee: IMI Cornelius Inc., Anoka, Minn.

[21] Appl. No.: 720,346

[22] Filed: Jun. 25, 1991

[51] Int. Cl.[5] ..... B67D 5/56

[52] U.S. Cl. ..... 222/129.1; 222/52; 439/377; 439/911

[58] Field of Search ..... 222/129.1-129.4, 222/146.6, 52; 200/553; 439/577, 893, 894, 374, 377, 911

[56] References Cited

U.S. PATENT DOCUMENTS 3,617,985 11/1971 Kehl ..... 439/577
4,936,488 6/1990 Austin ..... 222/129.1
5,002,204 3/1991 Sakai ..... 222/129.1

FOREIGN PATENT DOCUMENTS 2100067 12/1982 United Kingdom ..... 439/911
2179208 2/1987 United Kingdom ..... 439/911

*Primary Examiner*—Gregory L. Huson
*Attorney, Agent, or Firm*—Sten Erik Hakanson

[57] ABSTRACT

The present invention is a beverage dispensing valve having an exterior housing consisting of a main housing cover and an access plate slideably engageable therewith. The access plate houses electronics for controlling the operation of the valve wherein the electronic control is electrically connected to a power source and an operating solenoid through a plug connection. The plug connection provides for complete removal of the access plate from the remainder of the valve.

6 Claims, 3 Drawing Sheets

QUICK ELECTRONIC DISCONNECT FOR A BEVERAGE DISPENSING VALVE

BACKGROUND

1. Field of the Invention

The present invention relates generally to beverage dispensing valves and, in particular, to electronically controlled beverage dispensing valves.

2. Background of the Invention

Beverage dispensing valves, particularly of the post-mix type, generally include a valve body, a solenoid secured thereto for operation of valves held within the valve body. Electronically controlled valves, such as of the portion control type, will include the electronic control circuitry that provides for the timed dispensing of drinks of various volumes. Typically, the electronic control is wired to a power supply and includes a control lead wired to the solenoid, and is located on an interior surface of a cover or housing. The control circuitry is preferably mounted on the interior of the cover front surface in close association with the selection control switches that are activated by the operator when a drink of a particular size is desired.

Various strategies have been employed to make the front cover portion separably releasable from the remainder of the valve cover so that the control and/or valve components can be easily accessed. On many such valves, the cover is comprised of two parts, a rear housing cover portion and a front removable access cover plate. The cover plate is generally slideably engaged with the remainder of the housing and provides for quick access to the valve components.

Portion control valves, wherein a plurality of drink sizes are selectable and wherein the particular volume of drink dispensed for each size is programmable, can conveniently store such electronic components on the inside surface of the front access plate. Since the control electronics must be connected to a source of power and serve to operate the solenoid, a plurality of wires connect the circuit board with a solenoid and power source. Unfortunately, as the circuit board is secured to the front plate and to the wires, such connection interferes with the free removal of the access plate from the valve. Thus, repair and maintenance of the valve has been hindered by such solid wire connection.

Accordingly, it would be very desirable to have an access cover containing electronics that would be quickly and completely detachable from the remainder of the valve body.

SUMMARY OF THE INVENTION

The present invention is a quick disconnect for an electronically controlled dispensing valve having control electronics secured to a removable access cover. The valve includes interior valve components, such as a valve body and solenoid, which interior components are protected by an exterior cover. The exterior cover consists of two components, the valve body main cover and the access cover slideably engaged therewith. The access cover includes the circuit board containing the electronics for controlling the operation of the valve. The circuit board includes a male plug secured thereto for cooperating with a female plug secured to the valve body.

In operation, male and female plugs are aligned such that when the access cover is slideably engaged with the main housing the plugs cooperate to provide electrical connection from the circuit board to a power source and the solenoid. Thus, it can be appreciated that the access cover is completely removeable from the remainder of the valve housing by providing for quick and complete access to the valve operating components by service personnel. Furthermore, it can be understood that the access cover is, in a similar manner, easily reconnected with the remainder of the housing.

BRIEF DESCRIPTION OF THE DRAWINGS

Further objects and advantages of the present invention can be had by reading the following detailed description which refers to the following figures wherein.

BRIEF DESCRIPTION OF THE PREFERRED EMBODIMENT

Figure 1:
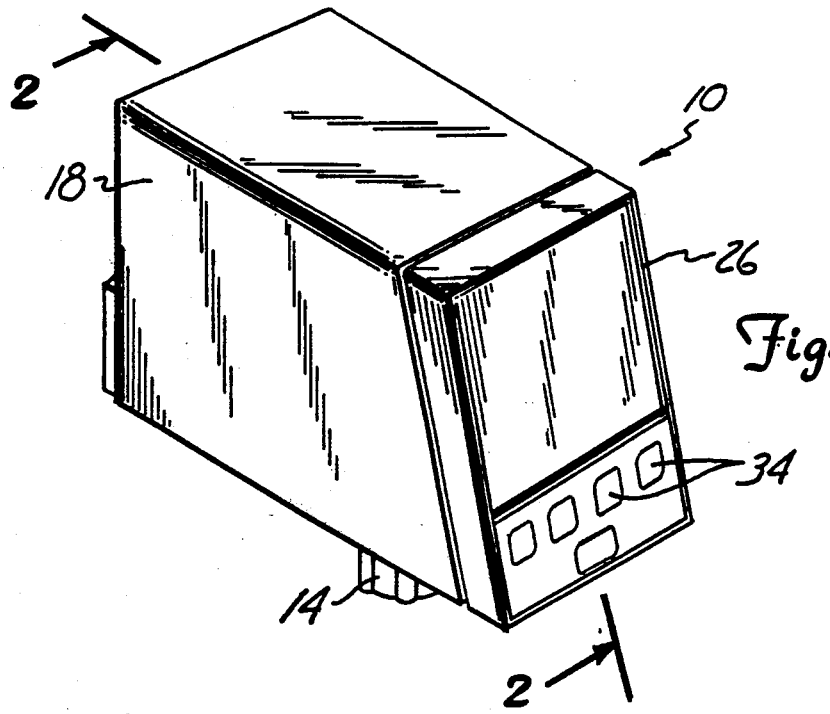
FIG. 1 shows a perspective view of the present invention.
Figure 2:
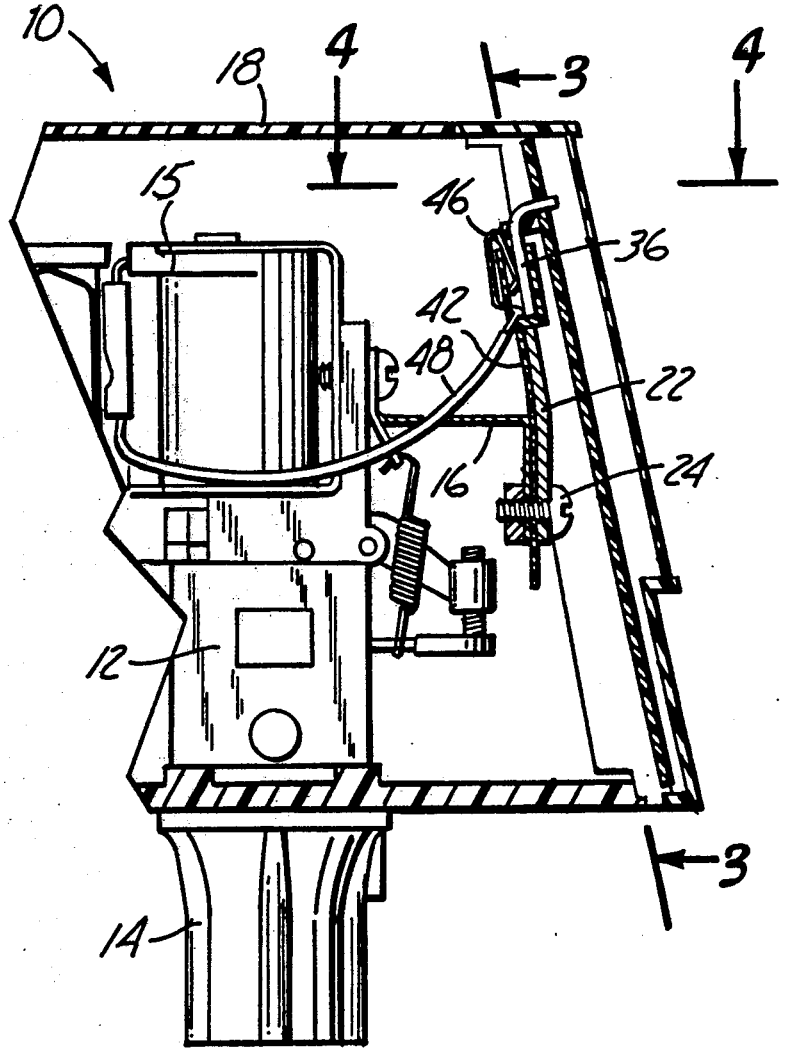
FIG. 2 shows a side cross-sectional view along lines 2—2 of FIG. 1.
Figure 3:
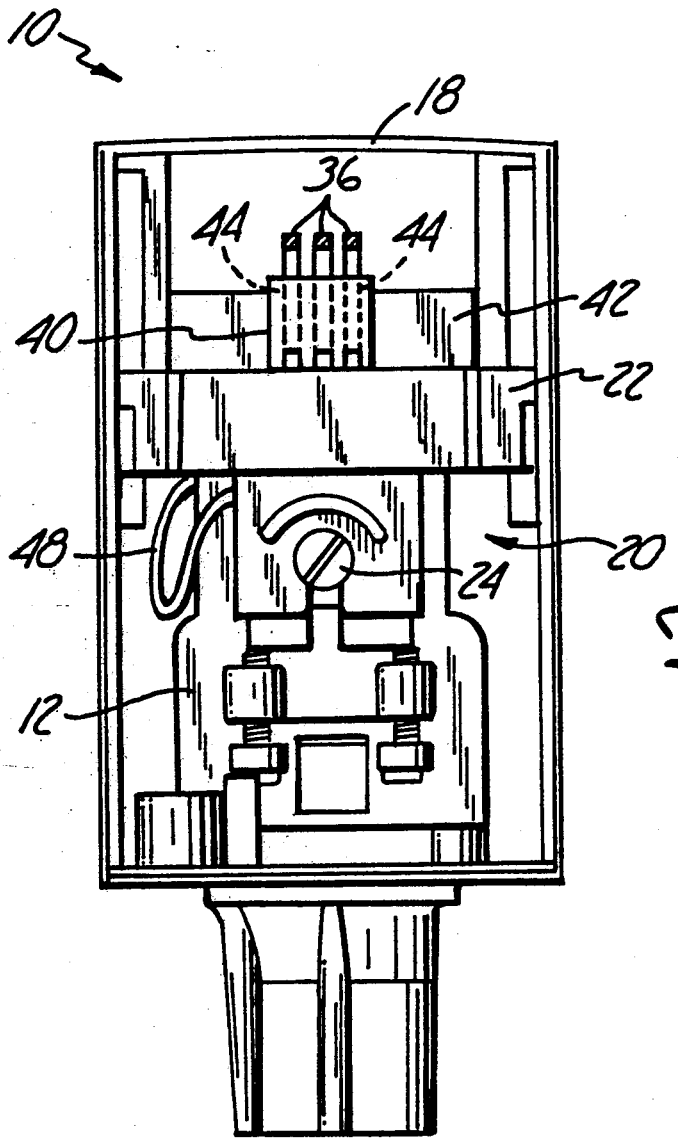
FIG. 3 shows a front end view along lines 3—3 of FIG. 2.
Figure 4:
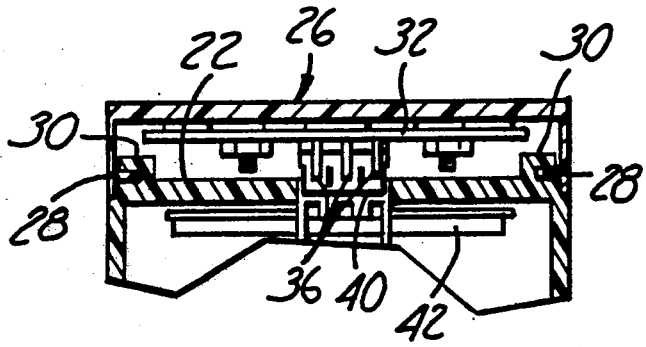
FIG. 4 shows a cross-sectional view along lines 4—4 of FIG. 2.
Figure 5:
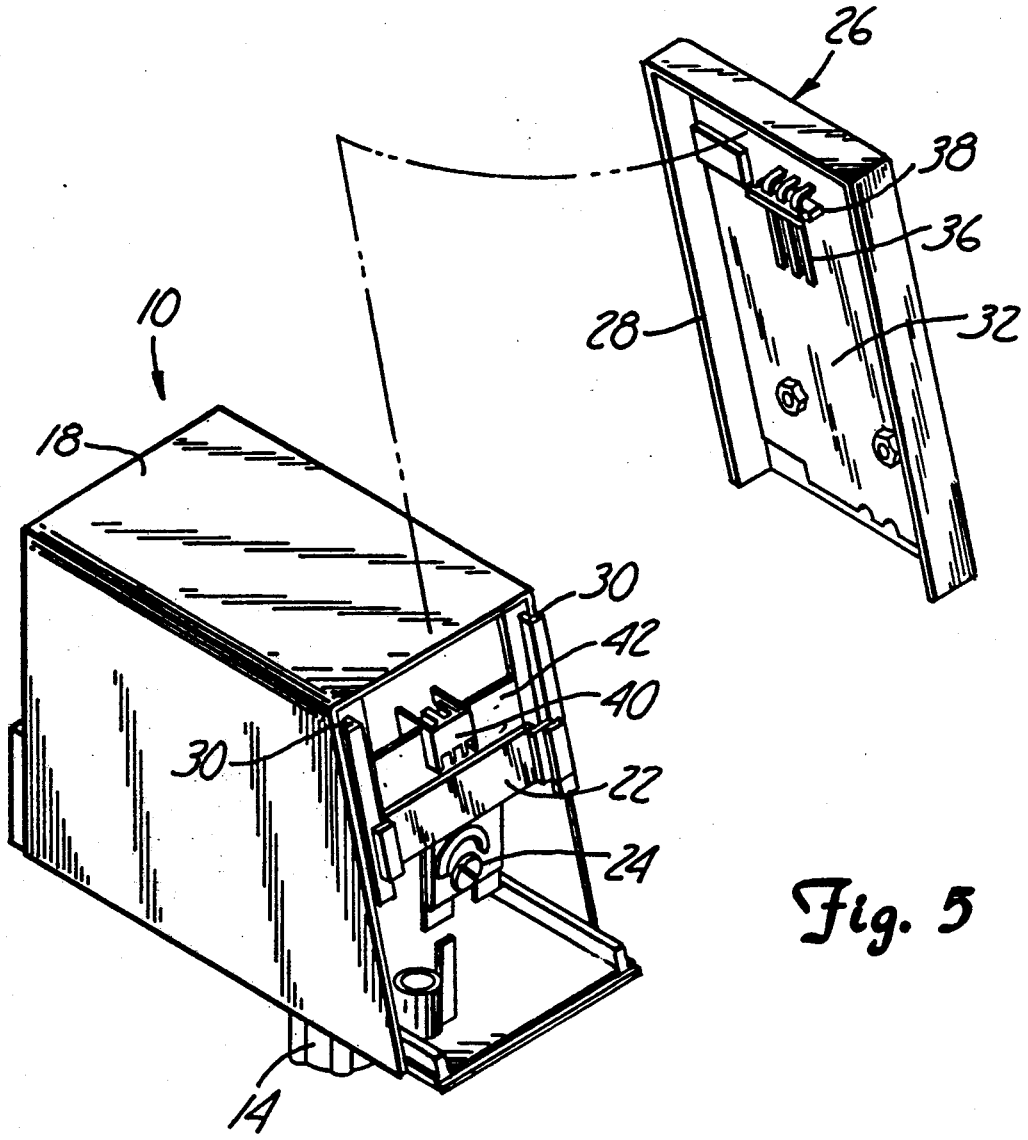
FIG. 5 shows an exploded perspective view of a valve having the quick disconnect of the present invention.

A beverage dispensing valve is seen in the various figures and referred to be the numeral 10. As is known in the art, valve 10 includes a valve body 12 having valves and fluid pathways, (not shown) for providing dispensing of a beverage from nozzle 14 into a suitable receptacle. A solenoid 15 is secured to valve body 12 and provides for operating valve 10. A support bracket 16 is secured to the front of valve body 12 and extends outwardly therefrom. Valve 10 includes an outer protective housing 18, having an open end 20 and a support portion 22 spanning end 20. Portion 20 is secured to bracket 16 by a screw 24 for attaching housing 18 to and around valve body 12.

An access plate 26 is slidingly engagable with housing 18. In particular, plate 26 includes a pair of ridges 28 for cooperating with a pair of grooves 30 of housing 18. Cover 26 includes a circuit board 32, secured to an inner surface thereof, containing the electronics for controlling the dispensing operation of valve 10. Board 32 is connected to a plurality of switches 34 located on the exterior of cover 26, switches 34 providing for the user operation of valve 10. Prongs 36 are electrically connected to the electronics of board 32 and are held in place on board 32 by a support 38. A female plug receptacle 40 is secured to a bracket 42, which, in turn, along with housing portion 20, is secured to and supported in position by bracket 16. Plug 40 includes openings 44 for receiving prongs and resilient contacts 46 for electrically contacting and retaining prongs 36. Contacts 46 are each connected to wire 48 for connection to a power supply and to solenoid 15.

In operation, it can be understood that prongs 36 and plug 40 are positioned so that they are engagable and disengageable by the sliding engagement and disengagement respectively of cover 26 with housing 18. In this manner the front cover 26 can be quickly and completely removed from housing 18. Thus, board 32, if faulty, can be quickly and easily replaced by substitution of an entirely new cover 26 and board 32. Moreover, the replacement can be done by a non-service person thereby saving time and money. Additionally, complete disengaging of cover 26 facilitates access to and adjustment of the various components of valve 10.

It will be appreciated by those of skill, that the access plate 26 can be located at different positions on housing 18 as, for example, along a top surface or side surface thereof. In addition, various plug means or releasable connection means could be used to provide the necessary releasable electrical connection between the circuit board 32 and the wiring 48 to the power supply and solenoid.

What is claimed is:

1. A beverage dispensing valve having a quick electrical disconnect, the valve for providing dispensing of a fluid beverage into a suitable receptacle, the valve connected to a power supply means and having an electrical operating means for opening and closing the valve, the valve comprising:

a valve body, and the operating means secured to the valve body, a valve cover for securing around the valve body and operating means, an access plate portion of the valve cover, the access plate portion releasably secureable with the valve cover, the access plate portion having electronic control means secured to an inner surface thereof, the electronic control means controlling the operating means for regulating the opening and closing of the valve, an electrical connecting means for providing a releasable electrical connection between the electronic control means, the operating means and the power supply means, the electrical connecting means including a first connecting portion secured to and electrically connected to the electronic control means and a second connecting portion secured to the valve body and electrically connected to the power supply means and the operating means, and the first and second connecting portions positioned on the access plate portion and valve body respectively for providing electrical connection there between when the access plate portion is secured to the valve cover.

2. The valve as defined in claim 1, and the access plate portion slideably engageable with the valve cover along a substantially linear path.

3. The valve as defined in claim 1, and the electrical connecting means first connecting portion comprising a plurality of prongs secured to the electronic control means and extending therefrom, and the second connecting portion comprising a receptacle having a same plurality of prong receiving sockets, the receptacle secured to the valve body and positioned thereon to permit the inserting cooperation of the prongs into the sockets when the access plate is engaged with the valve cover.

4. The valve as defined in claim 2, and the electrical connecting means first connecting portion comprising a plurality of prongs secured to the electronic control means and extending therefrom, and the second connecting portion comprising a receptacle having a same plurality of prong receiving sockets, the receptacle secured to the valve body and positioned thereon to permit the inserting cooperation of the prongs into the sockets when the access plate position is engaged with the valve cover.

5. A beverage dispensing valve having a quick electrical disconnect, the valve for providing dispensing of a fluid beverage into a suitable receptacle, the valve connected to a power supply means and having an electrical operating means for opening and closing the valve, the valve comprising:

a valve body, and the operating means secured to the valve body, a valve cover for securing around the valve body and operating means, an access plate portion of the valve cover, the access plate portion releasably slideably engageable with the valve cover along a substantially linear path, the access plate portion having electronic control means secured to an inner surface thereof, the electronic control means controlling the operating means for regulating the opening and closing of the valve, an electrical connecting means for providing releasable electrical connecting between the electronic control means, the operating means and the power supply means, the electrical connecting means including a first connecting portion secured to and electrically connected to the electronic control means and a second connecting portion secured to the valve body and electrically connected to the power supply means and the operating means, and the first and second connecting portions positioned on the access plate portion and valve body respectively for providing electrical connection there between when the access plate portion is secured to the valve housing.

6. The valve as defined in claim 5, and the electrical connecting means first connecting portion comprising a plurality of prongs secured to the electronic control means and extending therefrom, and the second connecting portion comprising a receptacle having a same plurality of prong receiving sockets, the receptacle secured to the valve body and positioned thereon to permit the inserting cooperation of the prongs into the sockets when the access plate portion is engaged with the valve cover.

* * * * *